US006179756B1

(12) United States Patent
Bertolucci et al.

(10) Patent No.: US 6,179,756 B1
(45) Date of Patent: Jan. 30, 2001

(54) EXERCISE METHOD AND APPARATUS FOR RELIEVING HIP AND BACK PAIN

(75) Inventors: Lawrence E. Bertolucci; Joan M. Bertolucci, both of Citrus Heights, CA (US)

(73) Assignee: Woodside Biomedical, Inc., Carlsbad, CA (US)

( * ) Notice: Under 35 U.S.C. 154(b), the term of this patent shall be extended for 0 days.

(21) Appl. No.: 08/126,336

(22) Filed: Sep. 23, 1993

Related U.S. Application Data

(63) Continuation of application No. 07/992,471, filed on Dec. 17, 1992, now abandoned.

(51) Int. Cl.[7] ..... A63B 21/002; A63B 23/04

(52) U.S. Cl. ..... 482/91; 482/131; 602/24

(58) Field of Search ..... 482/91, 121, 124, 482/126, 128, 131, 909, 139, 93; 5/648, 632, 650; 128/32, 33, 882, 869; 602/24; 606/240; 273/188 R, 191 B

(56) References Cited

U.S. PATENT DOCUMENTS

| | | | | |
|---|---|---|---|---|
| 1,635,638 | * | 7/1927 | Rogers | 128/882 |
| 1,973,240 | * | 9/1934 | Werness et al. | 5/646 |
| 2,589,322 | * | 3/1952 | Archer | 128/33 |
| 3,063,443 | * | 11/1962 | Wahl | 128/32 |
| 3,111,317 | * | 11/1963 | Cituk | 482/93 |
| 3,427,023 | * | 2/1969 | Silberman | 482/126 |
| 3,819,177 | * | 6/1974 | Spiro | 482/91 |
| 4,045,033 | * | 8/1977 | Schuman | 482/91 |
| 4,088,326 | * | 5/1978 | Bifulco | 273/188 R |
| 4,449,708 | * | 5/1984 | Humphrey | 273/191 B |
| 4,466,610 | * | 8/1984 | Israel | 482/91 |
| 4,607,629 | * | 8/1986 | Lerman | 602/24 |
| 4,830,366 | * | 5/1989 | Ruden | 482/124 |
| 4,889,109 | * | 12/1989 | Gifford | 606/240 |
| 4,909,051 | * | 3/1990 | Lee | 128/878 |
| 4,910,818 | * | 3/1990 | Grabill et al. | 602/24 |
| 4,943,047 | * | 7/1990 | Noble | 482/49 |
| 5,180,386 | * | 1/1993 | Kennedy, Jr. | 606/240 |
| 5,216,771 | * | 6/1993 | Hoff | 5/648 |

FOREIGN PATENT DOCUMENTS

| | | | | |
|---|---|---|---|---|
| 1123647 | * | 11/1984 | (SU) | 601/33 |

* cited by examiner

*Primary Examiner*—John Mulcahy
*Assistant Examiner*—Victor K. Hwang
(74) *Attorney, Agent, or Firm*—Kelly Bauersfeld Lowry & Kelley, LLP.

(57) ABSTRACT

An exercise device and method are provided for relieving hip and back pain. The device is a firm solid block with side surfaces contoured to fit between a patient's inner thighs. The device is placed between a seated patient's inner thighs just above the knees. By compressing the knees inwardly against the device, the adductor muscles are activated in isometric contractions. By pulling the knees outwardly, the piriformis muscles are activated in isometric contractions. Both actions relieve specific joint and soft tissue dysfunctions in the pelvic girdle and lumbar region thereby relieving hip and back pain.

14 Claims, 4 Drawing Sheets

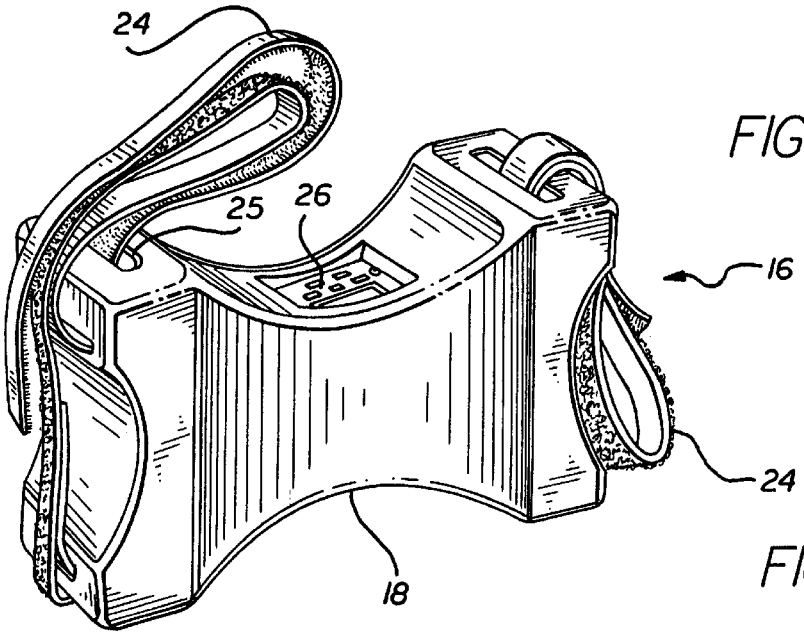
FIG. 1
FIG. 2
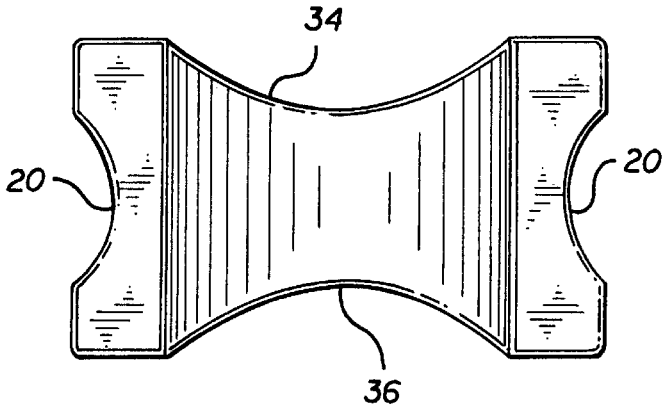
FIG. 3
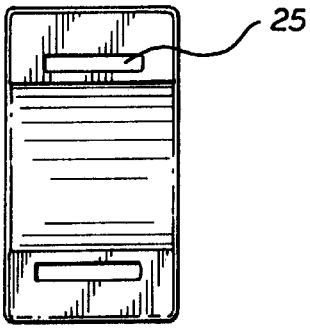
FIG. 4
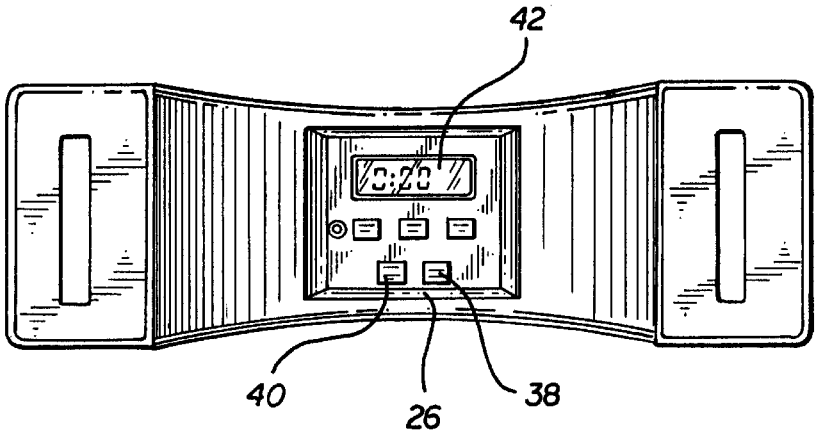

FIG. 5
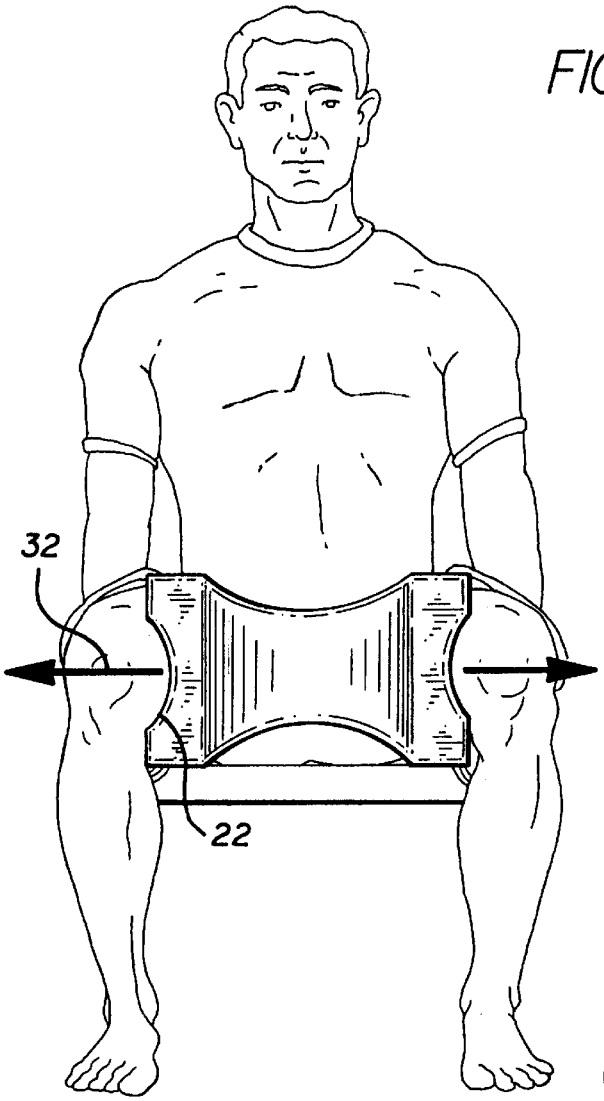
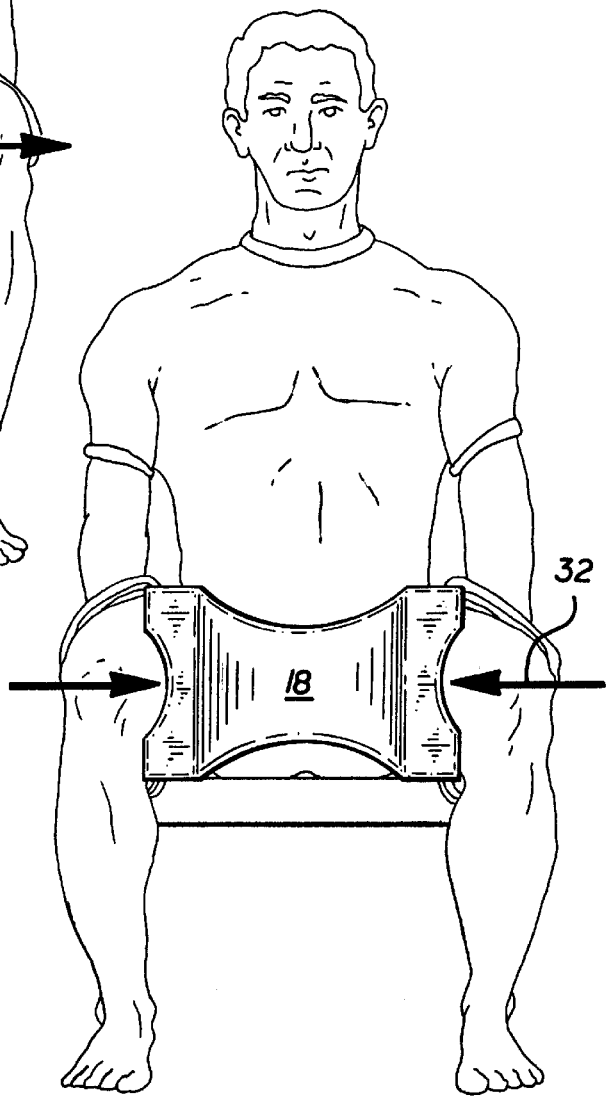
FIG. 6

EXERCISE METHOD AND APPARATUS FOR RELIEVING HIP AND BACK PAIN

This application is a continuation of application Ser. No. 07/992,471 filed on Dec. 17, 1992, abandoned.

FIELD OF THE INVENTION

This invention relates generally to exercise equipment and exercise therapy. More specifically, this invention relates to an exercise apparatus to relieve or eliminate hip and back pain and a method for its use.

BACKGROUND OF THE INVENTION

Back pain can be a chronic, very painful, frustrating experience for its sufferers. It also is a costly problem for society, causing millions of dollars to be expended annually in worker's compensation claims, lost time, etc.

Back pain can result from injury, disease, obesity, overuse, aging, childbirth, or any number of other reasons. Back pain can be caused by abnormal mechanical loading of certain joints and soft tissue (ligaments and tendons) in the pelvic girdle, including the pelvis itself. Specific regions which can be affected include:

(1) Ligament structures in the anterior pelvic region such that the pubic symphysis ends up elevated or depressed.

(2) The front or anterior pelvic region can be sprained by sudden deceleration activity when a linear force is exerted through one side of the pelvis from an extended braced lower extremity such as during braking of a car or, when the car is struck from the front or rear. This same force that is transferred through the hip is initially taken through the pelvis anteriorly and, secondarily, can create a posterior ilio-sacral joint or lumbo-sacral joint problem.

(3) The posterior iliac region can be tilted in a rotational dysfunctional position called "torsion".

(4) Sacral/lumbar dysfunction can occur in the anterior and posterior direction causing either excessive flat back or excessive lordosis (sway back).

(5) Sacral/lumbar dysfunction can also occur in a rotational/diagonal relationship placing increased strain on the ligament structures on the upper side of the sacrum and the opposite lower side.

(6) The sacral/coccyxgeal ligament may be traumatized causing pain in the tailbone (coccyx) and increased tension.

(7) Ilio-lumbar ligament tension problems are created by backward rotation of the affected pelvis. This creates tension on the affected side from the pelvis to the lower lumbar spine. This causes the fifth lumbar to rotate to the affected side compressing the supporting joint on that side creating excessive joint loading. This results in spasms.

(8) Lumbar disc disease creates a flattening effect of the vertebral column causing abnormal joint loading and compression.

(9) Lumbar osteoarthrosis.

(10) Lumbar postural strain/sprain.

Because of its many causes and the environmental, sociological, and individual morphological factors affecting back pain, there has been no panacea for its treatment. The usual and customary treatments for back pain have included drugs, physical therapy using a machine (electrical, traction, ultrasound and/or diathermy), hydrotherapy, massage, transcutaneous electrical nerve stimulation, micro-current stimulation, postural positioning, joint mobilization, exercise, and joint manipulation by a chiropractor. Surgery is also an option as a last resort. The myriad of options illustrates the inadequacy of any one of these treatments for relief.

Accordingly, there has been a need for a novel method and apparatus which is easy to be used by the back pain sufferer. There is a further need for a method and apparatus which can alleviate joint and soft tissue loading and tensile forces in the region of the pelvic girdle thereby relieving pain in the back and hip. The present invention fulfills these needs and provides other related advantages.

SUMMARY OF THE INVENTION

The present invention resides in an exercise method and apparatus which uses resistance to activate the adductor and piriformis (external hip rotator) muscles in isometric contractions. The apparatus comprises, generally, a firm, nondeformable or substantially nondeformable block contoured to comfortably fit between a seated patient's thighs just above the knees and against which resistance is applied by compressing the knees inwardly or by pulling them apart outwardly. This exercise corrects specific joint and soft tissue dysfunctions in the pelvic girdle and lumbar region thereby relieving back and hip pain.

In a preferred form of the invention, the block is utilized transversely between the inside of the thighs just above the knees and includes side surfaces having concave depressions to fit the contour of the inner thighs. The apparatus also includes a pair of straps to firmly hold the block to the thighs and a timer to indicate the elapsed exercise time. The patient's legs are caused to be astride each side of the block while the patient is exercising with the apparatus.

One exercise therapy method of the present invention comprises the steps of:

Placing the apparatus having concave side surfaces between the inner thighs just above the knees in a transverse direction between the legs so that the inner thighs are each fit into the respective side surfaces of the apparatus;

Compressing the knees inwardly toward each other against the apparatus to activate the adductor muscles in an isometric contraction; and Repeating said compression for prescribed periods of time.

The second exercise therapy method is identical to that described above except that the knees are pulled outwardly to activate the piriformis muscles. It is recommended that the prescribed period of exercise time be six sets of the exercise for six seconds each with a minimum of six times per day.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of an exercise apparatus for relieving hip and back pain embodying the novel features of the invention;

FIG. 2 is a front elevational view of the apparatus;

FIG. 3 is a left side elevational view of the apparatus;

FIG. 4 is a top plan view of the apparatus;

FIG. 5 is a front elevational view illustrating use of the device by outward movement of the knees;

FIG. 6 is another front elevational view illustrating use of the device by inward compression of the knees;

DETAILED DESCRIPTION OF THE PREFERRED EMBODIMENTS

Figure 7:
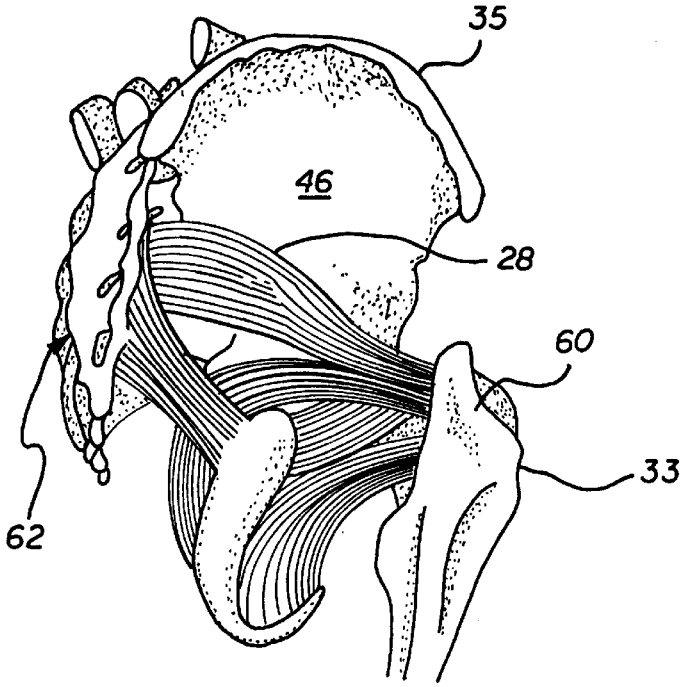
FIG. 7 is a cutaway view of one half of the pelvic girdle including the piriformis muscle.

As shown in the drawings for purposes of illustration, the present invention is concerned with an exercise apparatus, generally designated in the accompanying drawings by the reference number 16, and an exercise method for its use. The apparatus 16 comprises, generally, a firm solid or nondeformable block 18 having concave side surfaces 20 contoured to fit the shape of the inside of a patient's thighs 22, a pair of leg straps 24 to hold the block securely to the thighs, and a timer 26 to measure exercise time.

Resistance against the block is applied to activate the piriformis 28 (FIG. 7) and adductor 30 (FIG. 8) muscles in isometric contractions. The piriformis muscles 28 are activated by outward movement of the knees 32 (FIG. 5). The adductor muscles are activated by compressing the knees inwardly (FIG. 6). The exercise method of the present invention biomechanically corrects joint and soft tissue dysfunctions in the pelvic girdle 35 and lumbar region 37 relieving back and hip pain as will be described hereinafter. Isometric contractions must be contrasted with isotonic contractions commonly associated with thigh exercisers (e.g. Thigh Master™). Unlike isotonic contractions, there is no joint movement with isometric contractions of the muscle as in the present invention.

In accordance with the present invention, and as illustrated with respect to a preferred embodiment in FIGS. 1–11, the exercise apparatus 16 is configured for placement between the inner thighs 22 to extend transversely just above the knees 32 on a seated patient as shown in FIGS. 5 and 6.

The block 18 is preferably constructed of a firm solid material, for example heavy dense plastic of a nondeformable construction such as polypropylene that can be readily contoured to the convexity of the inside of the thighs 22 but which is of sufficient bulk and rigidity to provide resistance to inward compression of the knees 32, i.e. the block is substantially incompressible and in the preferred form, incompressible.

The block may include upper and lower concave portions 34 and 36 as illustrated in FIGS. 1–6, but these are included for cosmetic reasons only.

Leg straps 24 on either end of the apparatus wrap around the respective thigh to hold the apparatus 16 firmly between the legs. The straps include hook and loop tape for adjusting the length of the straps and are threaded through elongated slots 25 in the corners of the apparatus.

The apparatus also includes the timer 26 which can be set to the prescribed therapy time. The timer allows the exercising individual to preset the prescribed time. When the time has elapsed, the timer will beep indicating the exercise period has been completed. The individual can then press a reset button 40 which will reactive the time period. The timer may also include a typical digital clock 42 indicating the time of day. In more severe cases of chronic back pain, the apparatus 16 can be worn while sitting at an individual's place of employment. On a hourly basis, the individual can note when an hour has elapsed since his last therapy session, and begin the exercise by pressing a start button 38 on the timer 26 which activates the timer for the prescribed exercise period.

Figure 9:
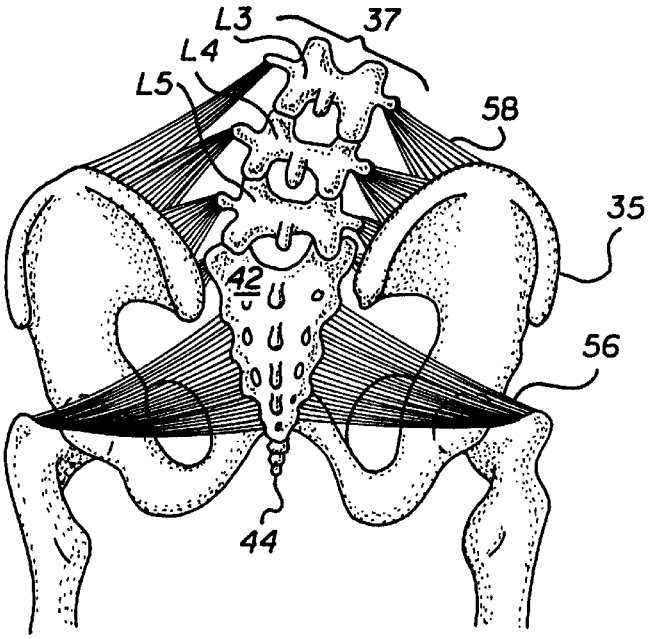
FIG. 9 is a rear view of the pelvis illustrating the right side in a dysfunctional state including tension on the ilio-sacral and ilio-lumbar ligaments and rotation and compression of the joints.
Figure 10:
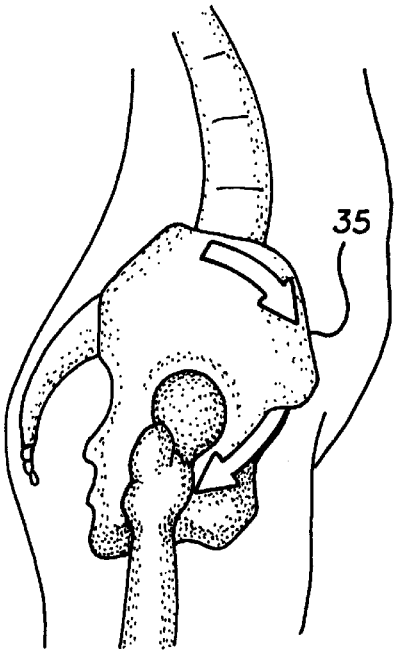
FIG. 10 is a side view of the pelvis illustrating lumbar lordosis.

The human spine includes five lumbar vertebra, the lowest three of which are shown in FIG. 9 and designated as $L_3$-$L_4$-$L_5$. Below the lumbar vertebrae, the spine terminates with two groups of vertebrae fused into single bones, the sacrum 42 and the coccyx 44, as viewed in FIG. 9.

The pelvis or pelvic girdle is the basin formed by the hip bones and lower portion of the vertebral column, constituting the lowest part of the trunk. The pelvis is formed by the sacrum 42, the coccyx 44 and the ilium 46, pubis 48 and ischium 50 (FIG. 8), bones that form the hip and pubic arch 52. A femur fits into a socket in each hip bone.

Figure 8:
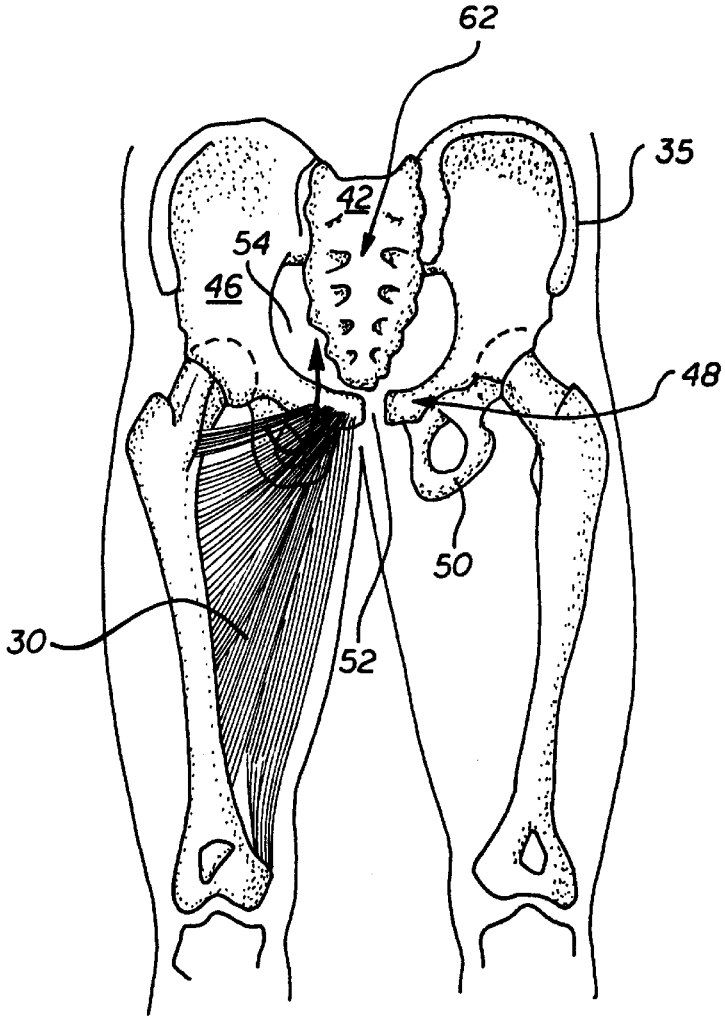
FIG. 8 is a front elevational view of the pelvis to depict the femurs in association with the adductor muscles, and illustrating (by arrow) prospective elevation of the pubic arch.

Posterior pelvic torsion is one example of a back condition which can be alleviated using the exercise apparatus and method of the present invention. Such condition results in superior elevation of the anterior pubic arch 52. FIG. 8 shows the pubic arch 52 in its normal, non-elevated position. As a result of posterior pelvic torsion, the pubic arch can become elevated in the direction of the arrow 54 of FIG. 8. It also results in downward displacement of the spine causing increased strain on the ilio-sacral and ilio-lumbar ligaments 56 and 58 and increased compression of the joints $L_3$, $L_4$ and $L_5$ (FIG. 9).

By applying an isometric contraction to the hip adductor muscles 30 upon inward compression of the knees as shown in FIG. 6, the anterior pubic arch will move back to mid-position and relieve strain on the ilio-sacral and ilio-lumbar ligaments 56 and 58, thereby effecting decreased compression of the joints.

Figure 11:
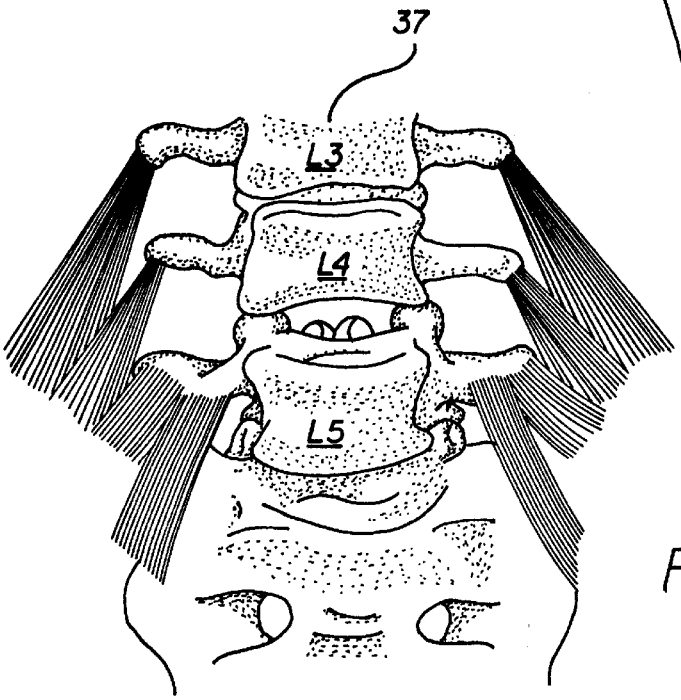
FIG. 11 is a rear view of a lumbar vertebral column illustrating abnormal disc space between the third and fourth vertebrae.

Other illustrated back conditions which can be relieved by the claimed apparatus and method of the present invention include an abnormal pelvic tilt with accentuated lordosis (FIG. 10) causing an increase in lumbar-sacral angle and joint compression and pain as well as abnormal disc space between, for example, the vertebrae $L_3$ and $L_4$ (FIG. 11).

An isometric contraction can be applied to the piriformis muscles 28 by pulling the knees outwardly as illustrated in FIG. 5. The piriformis muscle 28 comes off the posterior aspect of the greater trochanter 60 (FIG. 7) of the hip and is attached to the anterior (front) inferior (lower aspect) of the sacral bone 62. By pulling the knees outwardly to activate the piriformis muscles, the sacrum can be moved from a forward tilted or "nutated" position into a reverse "counter-nutated" or flat back position. This assists in reducing the severity of the lumbo-sacral angle or "sway back" (lordosis) by unloading lumbo-sacral joints. It also facilitates reducing tension on the sacral-coccyxgeal ligaments, thereby reducing tailbone pain. In addition, the exercise moves the sacrum backward activating the lower abdominal and gluteal muscles to flatten the back causing the discs to move into a "silent zone" to reduce pressure on certain nerves and other pain sensitive structures.

Although the apparatus has been described and illustrated with respect to several back conditions, those back conditions not specifically described or illustrated, including those listed in the Background of the Invention, can similarly be relieved by using the exercise apparatus and method of the present invention.

One of the methods of the present invention comprises the steps of:

Placing the apparatus having concave side surfaces between the inside of the thighs just above the knees in a transverse direction to the legs so that the insides of the thighs are placed on the respective side surfaces of the apparatus;

Compressing the knees inwardly against the apparatus to activate the adductor muscles in an isometric contraction; and Holding said compressions for about 6 seconds.

Repeating said steps for at least about six times per day.

The second method of the present invention is used to activate the piriformis muscles and comprises the steps of:

Placing the apparatus having concave side surfaces between the inside of the thighs just above the knees in a transverse direction to the legs so that the insides of the thighs are placed on the respective side surfaces of the apparatus; and Moving the knees outwardly away from the apparatus;

Holding the knees outward for about six seconds; and

Repeating said steps at least about six times per day.

Although a particular embodiment of the invention has been described in detail for purposes of illustration, various modifications may be made without departing from the spirit and scope of the invention. Accordingly, the invention is not to be limited, except as by the appended claims.

We claim:

1. An exercise apparatus against which resistance is applied to activate the piriformis or adductor muscles for relieving hip and back pain, comprising:

a nondeformable block having concave side surfaces, said side surfaces contoured to receive and engage a seated patient's inner thighs just above the knees;

a pair of leg straps to wrap around each respective thigh to hold said block securely between said thighs while the knees are compressed to activate the adductor muscles or while the knees are moved outwardly to activate the piriformis muscles.

2. The exercise apparatus of claim 1 further comprising a timer mounted on the block, the timer visible to the patient for measuring elapsed exercise time.

3. An exercise therapy method for relieving hip and back pain, comprising:

placing a substantially nondeformable block having concave side surfaces and a timer, between a seated patient's inner thighs just above the knees such that the inner thighs fit into the side surfaces;

compressing the knees inwardly against the block;

holding said compression for a prescribed period of time and number of times.

4. The exercise therapy method of claim 3 wherein said prescribed period of time is about six seconds.

5. The exercise therapy method of claim 3 wherein said prescribed number of times is about six sessions for about six times per day.

6. An exercise therapy method for relieving hip and back pain, comprising:

placing a substantially nondeformable block having concave side surfaces, leg straps on both sides of the block, and a timer between a seated patient's inner thighs just above the knees such that the inner thighs fit into the side surfaces and the straps are secured to each of the respective thighs;

moving the knees outwardly away from the block;

holding said outward movement for a prescribed period of time, and number of times.

7. The exercise therapy method of claim 6 wherein said prescribed period of time is about six seconds.

8. The exercise therapy method of claim 6 wherein said prescribed number of times is about six sessions for about six times per day.

9. An exercise apparatus against which resistance is applied to activate the piriformis or adductor muscles for relieving hip and back pain, comprising:

a nondeformable block having concave side surfaces, said side surfaces being contoured to receive and engage a seated patient's inner thighs; and means to mount said block between the patient's inner thighs just above the knees.

10. The exercise apparatus of claim 9 wherein said mounting means includes a pair of leg straps which wrap around each respective thigh.

11. An exercise therapy method for relieving hip and back pain, comprising:

placing a substantially nondeformable block having concave side surfaces between a seated patient's inner thighs just above the knees such that the inner thighs fit into the side surfaces;

compressing the knees inwardly against the block;

holding said compression for a prescribed period of time and number of times.

12. The exercise therapy method of claim 11 further comprising measuring elapsed compression time by a timer mounted on the block at a position visible to the patient.

13. An exercise therapy method for relieving hip and back pain, comprising:

placing a substantially nondeformable block having concave side surfaces, and leg straps on both sides of the block, between a seated patient's inner thighs just above the knees such that the inner thighs fit into the side surfaces and the straps are secured to each of the respective thighs;

moving the knees outwardly away from the block;

holding said outward movement for a prescribed period of time, and number of times.

14. The exercise therapy method of claim 13 further comprising measuring elapsed time of outward knee movement by a timer mounted on the block at a position visible to the patient.

* * * * *